United States Patent [19]

Histed

[11] 4,238,281

[45] Dec. 9, 1980

[54] SIMPLIFIED BLEACHING PROCESS

[75] Inventor: John A. Histed, L'Orignal, Canada

[73] Assignee: Canadian International Paper Company, Montreal, Canada

[21] Appl. No.: 34,922

[22] Filed: Apr. 30, 1979

[51] Int. Cl.[3] ..... D21C 9/14

[52] U.S. Cl. ..... 162/60; 162/89

[58] Field of Search ..... 162/89, 60

[56] References Cited

U.S. PATENT DOCUMENTS

| | | | |
|---|---|---|---|
| Re. 28,884 | 6/1976 | Jack et al. | 162/89 |
| Re. 28,887 | 6/1976 | Jack et al. | 162/89 |
| 2,587,064 | 2/1952 | Rapson | 162/89 |
| 3,698,995 | 10/1972 | Rapson | 162/89 |
| 3,865,685 | 2/1975 | Hebbel et al. | 162/78 |
| 3,874,992 | 4/1975 | Liebergott | 162/89 |
| 4,013,506 | 3/1977 | Histed et al. | 162/49 |
| 4,104,114 | 8/1978 | Rowlandson et al. | 162/89 |

OTHER PUBLICATIONS

Kamyr Displacement Bleaching–a case story, Kamyr Bulletin, 187E, 1978, 162–189.

*Tappi*, vol. 57, No. 11, Nov. 1974, pp. 105–108.

*Tappi*, vol. 59, No. 3, Mar. 1976, pp. 75–77.

*Tappi*, vol. 55, No. 6, Jun. 1972, pp. 933–936, 937–940.

"The Bleaching of Pulp", Monograph No. 27, Chapter 17, pp. 346 et seq., Tappi, (1963).

*Primary Examiner*—William F. Smith

[57] ABSTRACT

A multi-stage, bleaching process for alkaline cooked pulps, including at least four bleaching stages and no more than three washing steps, is provided, wherein certain of the bleaching stages are shortened to less than about 15 minutes.

21 Claims, 5 Drawing Figures

THE EFFECT OF $D_1$ RESIDUAL ON $E_2$ VISCOSITY AND $D_2$ VISCOSITY

COUNTERCURRENT FLOWS FOR THE (DC) E (HD) OR (DC)E (HDED) OR (DC)E (DED) SEQUENCES

SIMPLIFIED BLEACHING PROCESS

BACKGROUND OF THE INVENTION

This invention relates generally to improvements in processes for bleaching cellulosic materials in the form of pulp, such as wood pulp, and particularly to the rapid bleaching of high consistency pulp, with fewer washing stages, to obtain a pulp of improved quality and properties from a given bleach sequence.

Pulp, as it comes from the digester, whether produced from hardwood or softwood, contains residual coloring matter. While unbleached pulp may be used for the manufacture of certain grades of paper, for example, heavy wrapping paper and paper for use in bags, pulp which is to be used for printing or writing paper or paper which is to be dyed, must be bleached. Furthermore, bleaching may be required in order to remove impurities if the pulp is to be used as a raw material for the production of rayon, gun powder, and other cellulose products.

Depending upon the nature of the raw pulp and the end use of which the pulp will be employed, various chemical bleaching stages and various sequences of these stages have been used heretofore. Among the principal chemical bleaching stages which have been used are the chlorination stage (designated "C"), the caustic extraction stage (designated "E"), the hypochlorite stage (designated "H"), and the chlorine dioxide stage (designated "D"). In addition, both chlorine and chlorine dioxide may be used in the same stage (designated "$C_D$") or ("$D_C$") and the chemicals may be used as a mixture or added sequentially. Various combinations of the above stages have been employed depending upon the specific conditions and bleaching requirements. For example, common bleaching sequences may include the following: CEH, CEHD, CEHED, CEHDED, and CEDED. Of these, the $C_D$EDED and $C_D$EHDED are the recognized standard sequences for producing 88+GE Brightness market pulp.

The $C_D$EDED sequence produces a high brightness pulp with a minimum of viscosity loss or cellulose degradation to the pulp. This results in a pulp which has high strength properties. The $C_D$EHDED sequence also produces high brightness, but the hypochlorite stage causes degradation of the cellulose in a controlled fashion. This results in some loss in paper strength, but the pulp requires less mechanical beating in order to develop its maximum strength, compared with pulp bleached by the $C_D$EDED sequence. The $C_D$EHED sequence is used to make the same type of pulp as the $C_D$EHDED sequence, but it has one fewer stage for control of brightness. The CEH sequence is used for semibleached pulp in the brightness range 65 to 75 GE Brightness Standard. The $C_D$EHD sequence is normally not used for pulp requiring brightness greater than 86 GE because bleaching to higher brightness with this sequence generally results in a severe loss in viscosity and strength.

In the initial chlorination stage, chlorine is added to the washed pulp received from the digester. Ordinarily, the chlorination stage (C) is performed at temperatures in the range of about 30° C. to 50° C., with a pulp consistency of about 3 percent. Under these conditions, the reaction time in the chlorination tower is about 30 to 60 minutes. The chlorine reacts directly with the lignin and other impurities in the pulp. Chlorine dioxide may be used in conjunction with chlorine ($C_D$) or in place of chlorine for the initial chlorination stage (D).

Following the chlorination stage, a caustic extraction stage (E) using a dilute aqueous solution of sodium hydroxide (0.5 to 5.0 percent NaOH based on oven-dry weight of pulp) is performed to dissolve the chlorinated and oxidized lignin as well as some of the resin. The extraction stage is usually performed at temperatures of about 50° C. to 80° C. for a period of about 60 to 120 minutes with a pulp consistency of 10 to 20 percent.

The next stage of bleaching is commonly a hypochlorite stage (H), although a chlorine dioxide stage is sometimes preferred. In the hypochlorite stage, either sodium hypochlorite (NaOCl) or calcium hypochlorite ($Ca(OCl)_2$) is used to further oxidize the remaining lignin and other impurities in the pulp. Some degradation of the pulp as a result of shortening the chain length of the cellulose molecule usually occurs in the hypochlorite stage. Normally, the hypochlorite stage is performed at temperatures between about 30° C. and 50° C., and at a pulp consistency of 3 to 15 percent. The time employed for the hypochlorite stage varies inversely with the pulp consistency and the temperature ranging from 1 to 2 hours at a 15 percent consistency at 30° C., up to 5 hours at a 3 percent consistency. A third stage hypochlorite tower may be commonly operated at a temperature of about 35° C. for a period of 90–120 minutes at a pulp consistency of 12 percent. There are a few hypochlorite stages in commercial operation where the temperature is as high as 80° C., at 12 percent consistency, in which case the retention time can be as low as 5 minutes.

Following the hypochlorite stage, there may be a second alkaline or caustic extraction stage (E) or a chlorine dioxide stage (D). The chlorine dioxide stage is usually designed for a 3 to 5 hour operation at about 11 percent consistency and a temperature around 70° C. to 80° C. As chlorine dioxide is a relatively mild bleaching agent and will produce a good pulp over a fairly wide range of conditions, it is particularly effective late in a multi-stage operation since the high temperature will tend to soften shives and a residual of chlorine dioxide will bleach out the thus softened shives.

In addition to some combination of the various bleaching stages outlined above, it is conventionally considered necessary in the pulping and bleaching arts to provide a washing stage between each of the bleaching stages in the sequence in order to remove the spent bleaching agent and the products of chemical reaction from the pulp prior to the beginning of the next bleaching stage so that the chemical requirements of the bleaching process may be minimized. Washing is ordinarily carried out by diluting the pulp to low consistency (usually 0.5 to 1.25 percent) followed by thickening to 10 to 15 percent consistency (by removal of some water) and washing on a drum type washer wherein an excess of wash water displaces the liquid in the pulp. Thus, there are two types of washing occurring on drum washers, first a dilution wash in the washer vat and a displacement wash as shower water passes through the sheet on the drum.

The present practice of multistage bleaching thus requires a period of 12 to 18 hours to bleach pulp to the desired brightness and viscosity values. Moreover, it is apparent that both the temperature and the consistency or dilution of the pulp are varied from stage to stage and for the interstage washing operations necessitating a high consumption of water and steam. Furthermore, the long periods of time required for each bleaching stage introduce problems in the control of the pulp quality, especially during periods of varying production rates, since a long period of time must elapse from the time a change or adjustment in the operation is made until the effect of that change may be observed. Consequently, it is evident that if a significant reduction in bleaching time could be effected, improved control of the multistage bleaching process, as well as substantial savings in time, would result. Additionally, the adaptability of the process to advanced control techniques, using on-line sensors and process control computers, such as those disclosed in Histed et al. U.S. Pat. No. 4,013,506, granted Mar. 22, 1977, commonly assigned, would be enhanced.

With the need to decrease energy consumption and water pollution from bleacheries, there has been a trend towards reduced fresh water consumption in bleacheries by means of countercurrent washing. See in this regard, U.S. Pat. No. 3,698,995; U.S. Pat. No. 4,104,114; Histed and Nicolle, *Tappi*, Vol. 59, No. 3, pp. 75–77 (March 1976); and Nelson et al., *Tappi*, Vol. 55, No. 6, pp. 933–936 (June 1972). These proposals show the very complex system of shower water and seal tank cascades required for countercurrent washing in a 5 or 6 stage conventional bleachery. In mill practice these flows are very difficult to keep in balance especially during periods of upset conditions which may occur quite frequently in normal mill operation. There have been proposals to not wash pulp at all during the bleaching process, although impurities were removed by thickening of the pulp after a low consistency first extraction stage. See in this regard, "The Bleaching of Pulp," Monograph No. 27, Chapter 17, pp. 346 et seq., *Tappi* (1963). This proposal resulted in low pulp viscosity and excessive and wasteful quantities of chemicals must be employed.

Others have eliminated shower water on some of the bleach washers, such as the $D_1$ stage or $E_2$ stage washers. See in this regard, Monograph No. 27, Chapter 17, supra; and Yankowski, *Tappi*, Vol. 55, No. 6, pp. 937–940 (June 1972). This has had the effect of eliminating the displacement wash component of the drum washer and reduced, but not necessarily eliminated, the dilution was obtained on the washer. The net effect has been to produce a smaller volume of more concentrated bleachery effluent for either internal or external treatment, but it does not provide the more rapid bleaching process of the present invention or the bleached pulp of enhanced properties and quality.

Before the proposals of countercurrent washing, when fresh water was used on the showers of all the washers, no attempt was made to adjust the flow of wash water with changes in production rate and there was no problem encountered with control of shower water to the washers. However, in a countercurrent washing system, problems are encountered keeping flows in balance, since the earlier bleach stages are dependent on availability of excess filtrate from later stage seal tanks for shower water. This problem of water balance is further aggravated when the production rate in some parts of the bleachery is different than in others, such as when the level in a down-flow bleach tower is lowered which increases production rate in the succeeding stages or vice-versa.

These problems of matching slower flow to production rate in countercurrent washing systems increase with increasing number of washers which must be kept in balance, i.e., increasing number of bleach stages with interstage washing and with the degree to which filtrates are recycled. The problem is greatest in a closed cycle mill using the Rapson-Reeve process, where all the water used in the bleachery has to be used in other parts of the kraft mill and ultimately all of the organic and inorganic waste products of bleaching enter the kraft liquor recovery system.

Other proposals have been made for eliminating washing in conjunction with one or more stages of a multistage bleaching process. Thus, U.S. Pat. No. 3,874,992 proposes press alkaline extraction pulp in which caustic is mixed rapidly with pulp at 10 percent consistency and then pressed to 30 to 40 percent consistency which effectively removed $\frac{2}{3}$ to $\frac{3}{4}$ of the liquid from the pulp before it was carried into a succeeding bleach stage. This process would not obtain the benefit of not washing before a chlorine dioxide stage (which is one of the advantages of the present invention) since most of the material that protects the cellulose from degradation would be removed in filtrate from the pressing. U.S. Pat. No. 2,587,064 suggests that in a bleaching sequence in which a chlorine dioxide stage (D) is to be followed by a hypochlorite stage (H), an intermediate washing between the two stages may be dispensed with, with a benefit to the brightness of the pulp. U.S. Pat. No. Re. 28,884 describes the omission of an intermediate water wash between a chlorine dioxide stage (D), employed as the initial bleaching stage, and a second stage which is a chlorination stage (C). This is known as sequential chlorination. U.S. Pat. No. Re. 28,887 has a disclosure similar to that of U.S. Pat. No. Re. 28,884, but suggests that washings may be eliminated after various stages of a multistage bleaching sequence, but not before a final chlorine dioxide (D) stage, so long as the first two stages are (1) chlorine dioxide followed by (2) chlorine.

The foregoing omissions of a washing stage in the bleaching sequence have not provided the advantages of the process of the present invention, which teaches the elimination of a washing step at particular stages in the multistage sequence.

In order to minimize the problems caused by the countercurrent washing processes and to obtain advantages over other processes which omit a washing step, it has been found possible by the process of the present invention to simplify the bleaching sequence so that there is a requirement of only three washing stages. In the simplified process of the invention, it is possible to produce a higher quality of pulp from a given bleach sequence; or, using fewer bleach stages, to produce a pulp quality that hitherto had only been possible by means of longer bleach sequences. For example, it has been possible to increase the pulp strength obtained from the $C_D$EDED sequence by using three wash stages, instead of the conventional five wash stages, and it has been possible to produce a 90 GE brightness pulp from the $C_D$EHD sequence with three wash stages which have the physical properties usually associated with the conventional $C_D$EDED sequence while maintaining most of the fast beating characteristics generally associated with the hypochlorite stage. In addition, it is possible to shorten drastically the time of the intermediate stages of the sequence.

It is, therefore, an objective of the present invention to provide a bleaching process which requires the use of minimum amounts of water, time, capital expenditure, space requirements, and external heat, and produces pulp of consistently high quality in which the bleaching stages are conducted with conventional static flow of the pulp during retention periods so that there is no substantial movement of the bleaching liquid employed with respect to the fibers making up said pulp.

It is another objective of the present invention to provide a bleached pulp of greater strength than was formerly possible from a number of other bleach sequences.

It is another objective of the present invention to provide a bleaching process which reduces the number of bleaching stages required to produce a given quality of pulp.

Another objective of the present invention is to provide a bleaching system for a multistage bleaching process wherein the number of dilution and washing steps is minimized.

Another objective of the present invention is to provide a means which facilitates keeping the flows to bleachery washers in balance.

Another objective of the present invention is to minimize the opportunities for different production rates to occur in different parts of the bleachery at the same time, as is caused when the level changes in a conventional down-flow tower.

Other objectives of the invention will be apparent to those skilled in the art from the present description, in conjunction with the appended drawings of which:

Figure 1:
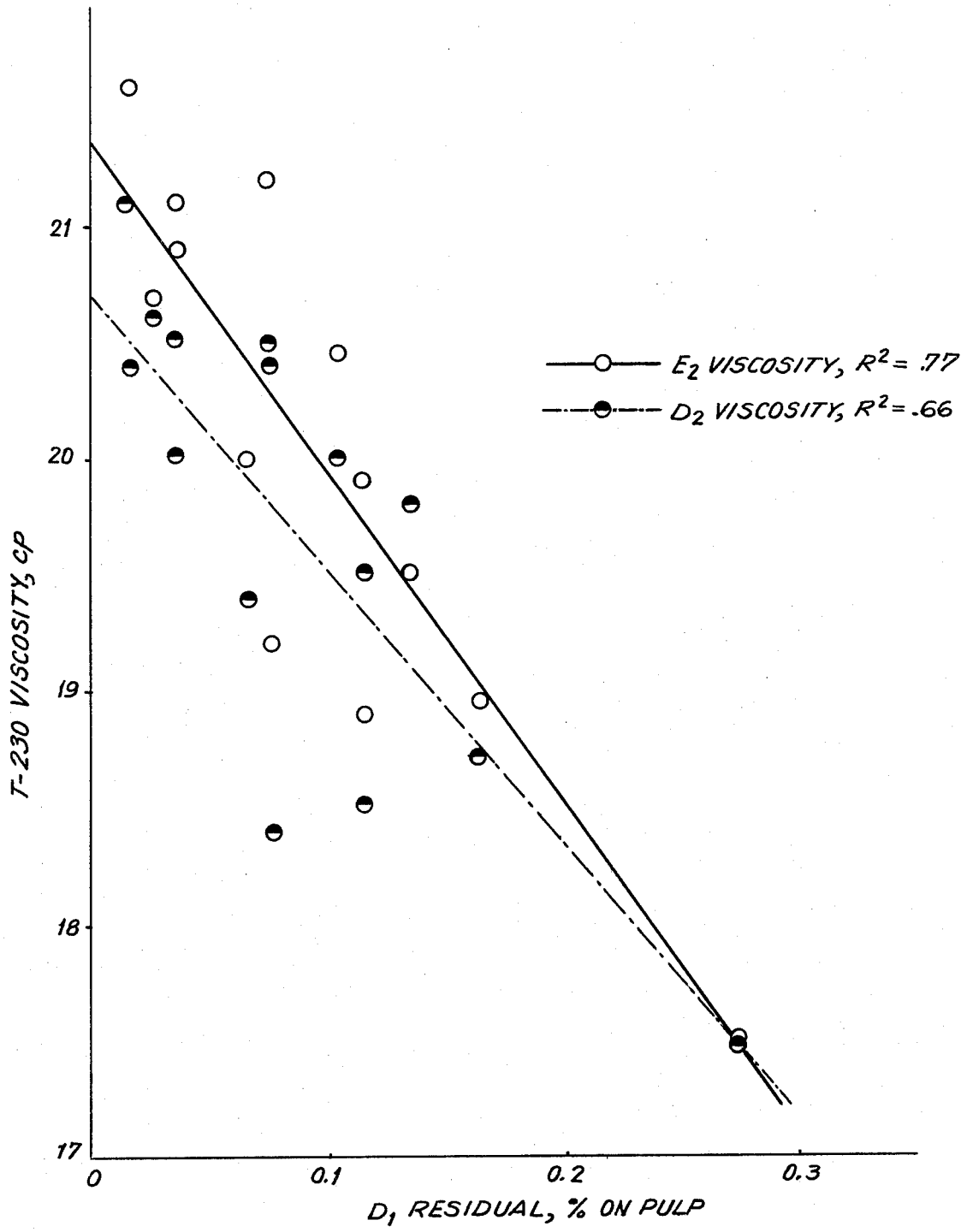
FIG. 1 is a graph demonstrating the effect of $D_1$ residual on $E_2$ and $D_2$ viscosities as illustrated by the experiments of Example III, below.

In FIGS. 2 through 5, inclusive, deckers and washers are depicted by circles, and seal tanks by squares, in accordance with the usual convention.

GENERAL DESCRIPTION OF THE INVENTION

The process of the invention comprises a multistage bleaching process for bleaching alkaline cooked pulps, such as those cooked by the kraft, alkaline sulfite and soda processes or those processes followed by an oxygen delignification. The process comprises a sequence of bleaching stages, in which the initial stage comprises a chlorination with chlorine alone, or chlorine dioxide alone, or with mixtures or sequential use of the two, and the final stage comprises a chlorine dioxide stage, in which washing is omitted immediately prior to the final or chlorine dioxide stage, but in which there is a washing step subsequent to the initial chlorination stage and/or prior to the first extraction stage. Another washing shall take place immediately subsequent to the first extraction stage. The bleaching stage immediately prior to the final and chlorine dioxide stage is preferably, but not necessarily, a hypochlorite stage (H) or alkali extraction stage (E). Thus, in the process of the invention, there are employed no more than three washing steps; i.e., (1) subsequent to the initial chlorination stage and/or prior to the second bleaching stage, (2) subsequent to the first extraction stage, and (3) subsequent to the final and chlorine dioxide bleaching stage.

Thus, by definition, the bleaching process of the invention comprises a sequence of at least four bleaching stages. Among the bleaching sequences which are encompassed by the process of the invention are:

| | | |
|---|---|---|
| CE(HDED) | CN(HDED) | $CE_H$(DED) |
| CE(HED) | CN(HED) | CE($DE_HD$) |
| CE(HD) | CE(DPD) | CE(DD) |
| CE(DED) | CE(DHD) | CE(HDD) |

The preferred sequence is depicted by $C_DE$(HD).

In the foregoing sequences, the symbols "E," "H," and "D" are as indicated above. "C" can represent chlorination, whether it is with chlorine alone (C), chlorine dioxide alone (D), mixtures of chlorine dioxide and chlorine ($C_D$), or sequential addition of chlorine dioxide and chlorine (DC). "N" represents a cold neutralization stage with alkali. "$E_H$" represents a hot alkaline extraction stage to which hypochlorite is added. "P" represents a peroxide stage. Where the symbols representing bleaching stages are encompassed by parentheses or brackets, washing is omitted between those stages within the parentheses or brackets.

Other possible bleach sequences for which the system is suited will be apparent to those skilled in the art.

Among the particular advantages of the process of the invention is that it permits greatly accelerated bleaching reactions to be carried out under controlled conditions. Whereas in the conventional bleaching sequences, each bleaching stage is separated by a washing step, and each stage normally required a time in the order of hours, namely, usually about 1 to 6 hours. However, in accordance with the process of the present invention, the retention time for each bleaching stage subsequent to the initial bleaching stage involving chlorination up to, and under some conditions including, the final chlorine dioxide stage, is dramatically shortened to less than about 15 minutes, preferably between about 5 and 10 minutes and desirably less than 5 minutes. Preferably, all bleaching stages following a first extraction stage and up to the final chlorine dioxide stage may be shortened according to the above time schedule. Expressed another way, the shortened retention stages are preferably those which do not have a wash subsequent thereto, such as those stages encompassed in parentheses or brackets, except the final chlorine dioxide stage in the sequences shown above. These are the "H," "P," "$E_2$" and "$D_1$" stages (when there is more than one D stage within the bracket). Under some conditions the final D stage may also be shortened to 10 to 20 minutes retention.

The short retention hypochlorite stage is operated at high temperatures above 70° C., and preferably in the range 80° C. to 90° C., so that all residual is consumed in 5 to 10 minutes. Hypochlorite addition is preferably controlled on feed back loop by an on-line optical sensor.

The short retention $D_1$ stage, in its optimum form, differs from conventional $D_1$ stages in that less chlorine dioxide is normally applied in $D_1$ and more in $D_2$ so that the total $ClO_2$ applied in $D_1$ plus $D_2$ is about the same. Any residual $ClO_2$ carried forward into the second extraction stage can degrade the cellulose at high pH, therefore, residual $ClO_2$ should be avoided. On the other hand, residual chlorite from the $D_1$ stage has no effect on viscosity in the $E_2$ stage. Chlorite or chlorine dioxide residuals carried forward into the acid condiions of the $D_2$ stage are reactivated for bleaching, particularly if the $ClO_2$ added for the final D stage contains small amounts of $Cl_2$. Bleaching in this way results in a higher viscosity pulp than conventional bleaching with interstage washing. On the other hand, if less $ClO_2$ is applied in $D_1$ and more in $D_2$ of a conventional bleach sequence with interstage washing, the viscosity of the bleached pulp is adversely affected. Therefore, the $C_DE(DED)$ sequence with a short retention $D_1$ stage is clearly distinguished from a conventional $C_DEDED$ bleach sequence.

The shortened retention bleaching stages provide important savings, not only in time, but in capital investment and mill space. Whereas long retention bleaching stages require large volume towers requiring substantial capital investment, shortened retention stages require only short, small volume tubes or pipes through which the pulp passes during the bleaching stage. Tubes of about 3 to 4 feet in diameter are suitable. Thus, economy is provided through savings in operating expenses, including energy savings.

What is further surprising about the process of the invention is that, in addition to the foregoing economies provided, the resulting pulp possesses advantageous physical properties, including strength values superior to those of pulp produced by comparable conventional processes. This will be demonstrated by the examples below. This is surprising because it has been thought that the conventional processes of the prior art with longer retention times, with washes between each stage, gave optimum strength values.

The temperature, concentration, time, consistency, pH, and other conditions used for chlorination, first caustic extraction and final chlorine dioxide bleaching are those normally used in the industry except, if there are two chlorine dioxide stages, the final stage has higher $ClO_2$ concentration. The hypochlorite stage has the same concentration of chemical as a conventional hypochlorite stage but has a higher temperature and preferably a higher pH. The short retention $D_1$ stage has lower $ClO_2$ concentration than conventional prior processes but compensating higher concentrations are used in the final $D_2$ stage. The short retention $E_2$ stage differs only in retention time from prior processes.

Another advantage of the process of the invention is that it makes unnecessary any need for dilution and rethickening of the pulp as it is transferred from one bleaching stage to another. Thus, except for the initial chlorination stage and first extraction stage in the sequence of four bleaching stages, no need is found to alter the consistency of the pulp in transferring from bleaching stages. Thus, once a satisfactory consistency is established at the first extraction stage, it need not be altered thereafter. This is an advantage not shared by prior bleaching processes where there is a washing between every stage. In such prior processes, employing large diameter bleaching towers, it is necessary to dilute the pulp consistency to remove it from the conventional tower and then rethicken the pulp again before it reaches the next tower. In those stages of the present process, which can be carried out in short retention bleaching tubes, as described above, it is not necessary to undertake such dilution to remove the pulp from the tube and to rethicken it before it reaches the short retention tube of the next bleaching stage.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

EXAMPLE 1

A northwestern softwood kraft pulp was chlorinated and extracted according to the conditions set forth in Table I, below. The extracted pulp was then subdivided and duplicate bleaches were performed using the $C_DEHD$, $C_DE(HD)$, $C_DE(HE)D$, $C_DE(HED)$, $C_DE(HDE)D$, $C_DE(HDED)$, $C_DE(DE)D$, and $C_DE(DED)$ sequences. Brackets or parentheses around two or more stages indicates that there was no washing between the stages within the bracket. In this experiment, the total bleach applied, all expressed in terms of available chlorine, was the same, regardless of the number and type of bleaching stages. Details of the bleaching conditions used in these sequences are also given in Table I, below.

TABLE I

EXAMPLE I

BLEACHING CONDITIONS AND RESULTS FOR SOFTWOOD PULP BLEACHED BY VARIOUS SEQUENCES

Unbleached pulp No.: Kappa No. 23.6: Roe No. 3.98; Viscosity 0.5% CED 26.8 cp $C_D$: Chlorination: 3.0% consistency, 30° C. 1 hour, 4.71% $Cl_2$ on pulp, 0.1% $ClO_2$ on pulp.

$E_1$: Extraction: 11.0% consistency, 80° C. 1 hour, 2.5% NaOH on pulp, Kappa No. 3.17; Visc. 0.5% CED 24.6 cp H: Hypochlorite: 11.0% consistency, 80° C., 6 minutes, 0.65% $Cl_2$ on pulp as NaOCl, % NaOH as shown, Brightness ≈ 71.

$D_1$: Chlorine Dioxide: 10.0% consistency, 80° C., retention time as shown, initial pH - 6.0, % $ClO_2$ on pulp as shown, brightness ≈ 78 for $C_DE(DE)D$ and 85 for $C_DE(HDE)D$ sequences.

$E_2$: Extraction: 11.0% consistency 80° C., % NaOH applied as shown.

$D_2$: Chlorine Dioxide: ≈ 10.0% consistency, 80° C., 4 hours retention time, initial pH - 6.0, % $ClO_2$ on pulp as shown.

| Bleach Sequence | $C_DEHD$ | | $C_DE(HD)$ | | $C_DE(HE)D$ | | $C_DE(HED)$ | | $C_DE(HDE)D$ | | $C_DE(HDED)$ | | $C_DE(DE)D$ | $C_DE(DED)$ |
|---|---|---|---|---|---|---|---|---|---|---|---|---|---|---|
| Hypochlorite H | | | | | | | | | | | | | | |
| Final pH | 10.7 | 10.6 | 10.5 | 10.8 | 9.5 | 9.4 | 9.4 | 9.3 | 9.7 | 9.7 | 9.4 | 9.3 | | |
| NaOH applied % on pulp | 0.66 | 0.66 | 0.66 | 0.66 | 0.23 | 0.23 | 0.23 | 0.23 | 0.23 | 0.23 | 0.23 | 0.23 | | |
| NaOH residual % on pulp | 0.45 | 0.42 | 0.39 | 0.39 | — | — | — | — | — | — | — | — | | |
| Chlorine | | | | | | | | | | | | | | |

TABLE I-continued

EXAMPLE I

BLEACHING CONDITIONS AND RESULTS FOR SOFTWOOD PULP BLEACHED BY VARIOUS SEQUENCES

Unbleached pulp No.: Kappa No. 23.6: Roe No. 3.98; Viscosity 0.5% CED 26.8 cp
$C_D$: Chlorination: 3.0% consistency, 30° C. 1 hour, 4.71% $Cl_2$ on pulp, 0.1% $ClO_2$ on pulp.
$E_1$: Extraction: 11.0% consistency, 80° C. 1 hour, 2.5% NaOH on pulp, Kappa No. 3.17; Visc. 0.5% CED 24.6 cp
H: Hypochlorite: 11.0% consistency, 80° C., 6 minutes, 0.65% $Cl_2$ on pulp as NaOCl, % NaOH as shown, Brightness ≈ 71.
$D_1$: Chlorine Dioxide: 10.0% consistency, 80° C., retention time as shown, initial pH - 6.0, % $ClO_2$ on pulp as shown, brightness ≈ 78 for $C_D$E(DE)D and 85 for $C_D$E(HDE)D sequences.
$E_2$: Extraction: 11.0% consistency 80° C., % NaOH applied as shown.
$D_2$: Chlorine Dioxide: ≈ 10.0% consistency, 80° C., 4 hours retention time, initial pH - 6.0, % $ClO_2$ on pulp as shown.

| Bleach Sequence | $C_D$EHD | | $C_D$E(HD) | | $C_D$E(HE)D | | $C_D$E(HED) | | $C_D$E(HDE)D | | $C_D$E(HDED) | | $C_D$E(DE)D | | $C_D$E(DED) | |
|---|---|---|---|---|---|---|---|---|---|---|---|---|---|---|---|---|
| Dioxide $D_1$ | | | | | | | | | | | | | | | | |
| $ClO_2$ applied % on pulp | 1.05 | 1.05 | 1.06 | 1.06 | | | | | 0.40 | 0.40 | 0.40 | 0.40 | 0.60 | 0.60 | 0.60 | 0.60 |
| $ClO_2$ residual % on pulp | 0.15 | 0.13 | 0.12 | 0.10 | | | | | 0.10 | 0.10 | 0.08 | 0.10 | 0.10 | 0.09 | 0.10 | 0.10 |
| Buffer applied % on pulp | 0.13 | 0.15 | 0.50 | 0.50 | | | | | 0.27 | 0.27 | 0.25 | 0.25 | 0.11 | 0.11 | 0.17 | 0.17 |
| | (NaOH) | | ($H_2SO_4$) | | | | | | ($H_2SO_4$) | | ($H_2SO_4$) | | (NaOH) | | ((NaOH) | |
| pH Start | 5.8 | 3.8 | 6.4 | 6.3 | | | | | 5.5 | 5.5 | 5.6 | 5.7 | 6.0 | 6.0 | 5.9 | 5.9 |
| pH Dump | 1.8 | 1.8 | 2.7 | 2.6 | | | | | 3.3 | 3.9 | 3.7 | 3.9 | 2.4 | 2.4 | 2.7 | 2.8 |
| Retention time minutes | 240 | 240 | 240 | 240 | | | | | 7.5 | 7.5 | 7.5 | 7.5 | 5 | 5 | 5 | 5 |
| Extraction $E_2$ | | | | | | | | | | | | | | | | |
| NaOH applied % on pulp | | | | | 0.43 | 0.43 | 0.43 | 0.43 | 0.60 | 0.60 | 0.60 | 0.60 | 1.02 | 1.02 | 0.99 | 0.99 |
| NaOH residual % on pulp | | | | | 0.42 | 0.39 | 0.52 | 0.52 | 0.21 | 0.28 | 0.28 | 0.28 | 0.49 | 0.44 | 0.46 | 0.86 |
| Final pH | | | | | 10.5 | 10.8 | 10.9 | 10.9 | 9.8 | 9.8 | 9.8 | 9.8 | 10.5 | 10.5 | 10.6 | 10.6 |
| $ClO_2$ residual % on pulp | | | | | — | — | — | — | 0.07 | 0.07 | 0.05 | 0.09 | 0.033 | 0.033 | 0.06 | 0.06 |
| Retention time minutes | | | | | 8 | 8 | 8 | 8 | 2.5 | 2.5 | 2.5 | 2.5 | 8 | 8 | 8 | 8 |
| Chlorine Dioxide $D_2$ | | | | | | | | | | | | | | | | |
| $ClO_2$ applied % on pulp | | | | | 1.05 | 1.05 | 1.06 | 1.06 | 0.65 | 0.65 | 0.65 | 0.65 | 0.72 | 0.72 | 0.72 | 0.72 |
| $ClO_2$ residual % on pulp | | | | | 0.15 | 0.16 | 0.13 | 0.15 | 0.07 | 0.09 | 0.10 | 0.10 | 0.10 | 0.08 | 0.08 | 0.08 |
| Buffer applied % on pulp | | | | | 0.07 | 0.08 | 0.49 | 0.55 | 0.20 | 0.20 | 0.27 | 0.27 | 0.17 | 0.17 | 0.55 | 0.55 |
| | | | | | (NaOH) | | ($H_2SO_4$) | | (NaOH) | | ($H_2SO_4$) | | (NaOH) | | ($H_2SO_4$) | |
| pH Start | | | | | 5.7 | 5.8 | 6.3 | 5.8 | 6.4 | 6.4 | 6.4 | 6.3 | 5.9 | 6.0 | 6.1 | 6.4 |
| pH Dump | | | | | 1.9 | 1.8 | 2.8 | 2.7 | 2.4 | 2.4 | 3.6 | 3.5 | 2.5 | 2.2 | 3.5 | 3.4 |
| Brightness, Absolute | 90.8 | 91.0 | 90.4 | 90.8 | 90.7 | 90.8 | 90.9 | 90.7 | 91.7 | 92.0 | 91.4 | 91.1 | 91.8 | 91.7 | 91.4 | 91.6 |
| Scan Rev. Brightness | 86.7 | 86.7 | 86.9 | 87.9 | 87.1 | 87.2 | 87.1 | 86.9 | 88.5 | 88.9 | 88.0 | 88.2 | 88.7 | 88.5 | 88.0 | 88.9 |
| Visc. 0.5% CED cp | 13.1 | 12.8 | 16.7 | 15.8 | 12.8 | 13.1 | 15.7 | 14.8 | 14.0 | 13.7 | 15.4 | 14.9 | 17.5 | 16.5 | 18.7 | 18.5 |

Table II, below, shows the average results for each of the duplicate bleaches of Table I, with respect to brightness, viscosity and physical properties. It can be seen from Table II that omitting the wash immediately ahead of the final chlorine dioxide stage, in accordance with the process of the invention, results in a significant improvement in viscosity for each bleach sequence, as well as improvements in tear factor, Mullen, breaking length and elongation at both 500 and 300 CSF (Canadian Standard Freeness). There is no significant effect on opacity or apparent specific volume. The conventional $C_D$EDED sequence, which is generally considered the standard for maximum strength in accordance with prior art processes, even benefits when the wash is omitted prior to the final (D) stage. The greatest improvement in strength due to omission of washing was obtained with the $C_D$E(HD) and $C_D$E(HED) sequences. These sequences, despite having a relatively severe hypochlorite and chlorine dioxide stages resulting in lower viscosity, had strength properties equal or superior to the $C_D$E(DE)D sequence.

TABLE II

EXAMPLE I
THE EFFECT ON PHYSICAL PROPERTIES OF NOT WASHING PULP BEFORE THE FINAL CHLORINE DIOXIDE STAGE

All data are the average of duplicate bleaches and duplicate beater tests.

| Bleach Sequence | $C_DEHD$ | $C_DE(HD)$ | $C_DE(HE)D$ | $C_DE(HED)$ | $C_DE(HDE)D$ | $C_DE(HDED)$ | $C_DE(DE)D$ | $C_DE(DED)$ | Average of 4 Sequences: Wash before D | Average of 4 Sequences: No Wash before D | $C_DNE_HD$ Control |
|---|---|---|---|---|---|---|---|---|---|---|---|
| Brightness, Elrepho Abs. | 90.9 | 90.6 | 90.75 | 90.8 | 91.85 | 91.25 | 91.75 | 91.5 | 91.3 | 91.0 | 91.7 |
| Scan Reverted Br. | 86.7 | 87.4 | 87.1 | 87.0 | 88.7 | 88.1 | 88.6 | 88.5 | 87.8 | 87.7 | 88.6 |
| Viscosity, T-230 cp | 12.95 | 16.25 | 12.95 | 15.25 | 13.85 | 15.15 | 16.9 | 18.6 | 14.16 | 16.31 | 14.2 |
| 500 CSF | | | | | | | | | | | |
| PFI Revolutions | 4701 | 5018 | 4774 | 4681 | 4476 | 4470 | 4829 | 4804 | 4695 | 4743 | 4480 |
| Tear Factor | 116 | 132 | 116 | 129 | 127 | 133 | 133 | 138 | 123 | 133 | 114 |
| Mullen, % pts/lb | 135 | 158 | 139 | 152 | 145 | 153 | 147 | 159 | 142 | 155 | 157 |
| Breaking Length, m | 9150 | 9750 | 9300 | 9450 | 9650 | 9900 | 9500 | 9650 | 9400 | 9688 | 9950 |
| Elongation | 3.3 | 3.7 | 3.35 | 3.55 | 3.6 | 3.65 | 3.6 | 3.8 | 3.46 | 3.67 | 3.05 |
| Opacity | 63.0 | 64.0 | 63.1 | 61.7 | 63.5 | 63.5 | 63.8 | 62.8 | 63.4 | 63.0 | 62.2 |
| App. Spec. Vol. | 1.46 | 1.47 | 1.48 | 1.47 | 1.49 | 1.46 | 1.48 | 1.50 | 1.48 | 1.48 | 1.45 |
| 300 CSF | | | | | | | | | | | |
| PFI Revolutions | 8276 | 8484 | 8384 | 8500 | 8158 | 8215 | 8800 | 8907 | 8404 | 8526 | 8041 |
| Tear Factor | 104 | 114 | 105 | 117 | 111 | 115 | 114 | 120 | 109 | 117 | 104 |
| Mullen, % pts/lb | 153 | 172 | 161 | 169 | 168 | 173 | 168 | 178 | 163 | 173 | 174 |
| Breaking Length, m | 10200 | 10700 | 10350 | 10650 | 10900 | 11050 | 10400 | 11300 | 10460 | 10925 | 11250 |
| Elongation | 3.5 | 3.75 | 3.45 | 3.5 | 3.25 | 3.65 | 3.8 | 3.9 | 3.5 | 3.7 | 3.5 |
| Opacity | 61.9 | 60.3 | 61.4 | 61.7 | 61.1 | 60.5 | 59.8 | 59.3 | 61.0 | 60.5 | 60.6 |
| App. Spec. Vol. | 1.41 | 1.41 | 1.41 | 1.42 | 1.41 | 1.38 | 1.40 | 1.41 | 1.41 | 1.41 | 1.39 |

T-230 = Tappi Test T-230

EXAMPLE II

A northwestern Canadian softwood kraft pulp was chlorinated and extracted and then subdivided for bleaching according to the conditions shown in Table III, below. The same amount of hypochlorite was used in all bleaches. For each bleach sequence, half of the pulp was hypochlorite bleached for 90 minutes at 50° C., and the other half was bleached for only 6 minutes at 80° C. In the sequences where there was no wash ahead of the final (D) stage, slightly more $ClO_2$ was applied. Testing results for the pulps in Table III are shown in Table IV, below. The fully bleached pulps which had a high temperature hypochlorite stage had marginally lower viscosity and tear but were equal in all other respects. Not washing ahead of the final chlorine dioxide stage, in accordance with the invention, resulted in a large improvement in tear factor and Mullen, particularly at 500 CSF for pulps bleached with either a high or a low temperature hypochlorite stage.

TABLE III

EXAMPLE II
Comparison of Low and High Temperature Hypochlorite Bleached Pulps in Four Bleach Sequences Unbleached pulp: Kappa No. 23.6, Roe No. 3.98, Visc T230 = 26.8 cp
$C_D$: 3.0% cs, 30° C., 1 hour, 4.71% $Cl_2$ + 0.1% $ClO_2$ on pulp, Chlorination Factor 1.25 × Roe No.
$E_1$: 11% cs, 80° C., 1 hour, 2.5% NaOH on pulp, Kappa No. 3.17, Visc 24.6 cp
H: 11% cs, sodium hypochlorite applied = 0.65% $Cl_2$ on pulp
$E_2$: ≈ 11% cs, 80° C., 8 minutes, NaOH applied = 0.43% on pulp
D: ≅ 10% cs, 80° C., 4 hours

| Bleach Sequence | $C_DEHD$ | | $C_DE(HD)$ | | $C_DE(HE)D$ | | $C_DE(HED)$ | |
|---|---|---|---|---|---|---|---|---|
| Hypochlorite Stage | | | | | | | | |
| Temperature °C. | 50 | 80 | 50 | 80 | 50 | 80 | 50 | 80 |
| Retention time, min | 90 | 6 | 90 | 6 | 90 | 6 | 90 | 6 |
| Final pH | 10.9 | 10.7 | 10.9 | 10.7 | 9.4 | 9.5 | 9.5 | 9.5 |
| NaOH applied, % on pulp | 0.66 | 0.66 | 0.66 | 0.66 | 0.23 | 0.23 | 0.23 | 0.23 |
| NaOH residual, % on pulp | 0.45 | 0.45 | 0.39 | 0.42 | — | — | — | — |
| Extraction Stage | | | | | | | | |
| NaOH residual, % on pulp | — | — | — | — | 0.39 | 0.42 | 0.51 | 0.52 |
| Final pH | — | — | — | — | 10.8 | 10.5 | 10.9 | 10.8 |
| Chlorine Dioxide Stage | | | | | | | | |
| $ClO_2$ applied, % on pulp | 1.05 | 1.05 | 1.21 | 1.21 | 1.05 | 1.05 | 1.21 | 1.21 |
| $ClO_2$ residual, % on pulp | 0.15 | 0.15 | 0.25 | 0.25 | 0.18 | 0.15 | 0.21 | 0.23 |
| NaOH, % on pulp | 0.16 | 0.13 | — | — | 0.08 | 0.07 | — | — |
| $H_2SO_4$, % on pulp | — | — | 0.50 | 0.55 | — | — | 0.55 | 0.55 |
| Initial pH | 6.4 | 5.8 | 6.1 | 6.0 | 5.8 | 5.7 | 5.9 | 6.1 |
| Final pH | 1.6 | 1.8 | 2.4 | 3.4 | 2.3 | 1.9 | 2.8 | 3.1 |
| Brightness, Absolute | 90.9 | 90.8 | 90.9 | 90.8 | 90.5 | 90.7 | 90.8 | 90.6 |
| Scan Reverted Br. | 87.0 | 86.7 | 86.5 | 86.5 | 86.8 | 87.1 | 87.9 | 86.8 |
| Visc, T-230 cp | 13.6 | 13.1 | 15.2 | 15.4 | 13.9 | 12.8 | 14.9 | 14.2 |

TABLE IV

EXAMPLE II
Comparison of Physical Properties for Conventional Low Temperature Hypochlorite Bleached Pulp with those of High Temperature Hypochlorite Bleached Pulp in Four Bleach Sequences

| Bleach Sequence | $C_DEHD$ | | $C_DE(HD)$ | | $C_DE(HE)D$ | | $C_DE(HED)$ | | Effect of Hypo Temp, Average of 4 bleach sequences | | Effect of wash before D Stage, Average of 4 bleaches | |
|---|---|---|---|---|---|---|---|---|---|---|---|---|
| Hypochlorite Stage | | | | | | | | | | | | |
| Temperature °C. | 50 | 80 | 50 | 80 | 50 | 80 | 50 | 80 | 50 | 80 | Wash | No Wash |
| Time, minutes | 90 | 6 | 90 | 6 | 90 | 6 | 90 | 6 | 90 | 6 | | |
| Chlorine Dioxide Stage | | | | | | | | | | | | |
| $ClO_2$ applied, % on pulp | 1.05 | 1.05 | 1.21 | 1.21 | 1.05 | 1.05 | 1.21 | 1.21 | 1.13 | 1.13 | 1.05 | 1.21 |
| Brightness | 90.9 | 90.8 | 90.9 | 90.8 | 90.5 | 90.7 | 90.9 | 90.6 | 90.8 | 90.7 | 90.7 | 90.8 |
| Viscosity, 0.5% | 13.6 | 13.1 | 15.2 | 15.4 | 13.9 | 12.8 | 14.9 | 14.2 | 14.4 | 13.9 | 13.35 | 14.9 |
| 550 CSF | | | | | | | | | | | | |
| PFI Revolutions | 4414 | 4647 | 4634 | 4790 | 4717 | 4812 | 4704 | 4694 | 4617 | 4736 | 4647 | 4705 |
| Tear Factor | 121 | 119 | 134 | 131 | 121 | 113 | 128 | 125 | 126 | 122 | 118.5 | 129.5 |
| Mullen, % pts/lb | 137 | 134 | 146 | 154 | 142 | 138 | 146 | 148 | 143 | 144 | 138 | 148.5 |
| Breaking length, m | 9400 | 9400 | 9200 | 9300 | 9500 | 9500 | 9000 | 9800 | 9275 | 9500 | 9450 | 9325 |
| Elongation | 3.6 | 3.4 | 4.0 | 3.7 | 13.2 | 3.5 | 3.6 | 3.6 | — | — | — | — |
| Opacity | 61.5 | 62.9 | 62.9 | 62.9 | 61.8 | 63.1 | 63.3 | 63.2 | 62.4 | 63.0 | 62.3 | 63.1 |
| Apparent Specific Vol. | 1.49 | 1.47 | 1.48 | 1.45 | 1.46 | 1.49 | 1.47 | 1.49 | 147.5 | 147.5 | 1.47 | 1.47 |
| 300 CSF | | | | | | | | | | | | |
| PFI Revolutions | 8013 | 8085 | 8844 | 8800 | 8371 | 8453 | 8722 | 8622 | 8488 | 8490 | 8230 | 8747 |
| Tear Factor | 115 | 108 | 113 | 112 | 116 | 107 | 116 | 112 | 115 | 110 | 111.5 | 113 |
| Mullen, % pts/lb | 161 | 152 | 159 | 168 | 170 | 160 | 160 | 171 | 163 | 163 | 161 | 164.5 |
| Breaking length, m | 10300 | 10000 | 11500 | 10800 | 10500 | 10600 | 10500 | 10800 | 10700 | 10550 | 10350 | 10900 |
| Elongation | 3.3 | 3.6 | 3.8 | 3.8 | 5.4 | 3.7 | 3.8 | 3.5 | — | — | — | — |
| Opacity | 61.7 | 61.0 | 59.8 | 62.1 | 61.9 | 61.4 | 59.7 | 61.5 | 60.8 | 61.5 | 61.5 | 60.8 |
| Apparent Specific Vol. | 1.41 | 1.41 | 1.41 | 1.39 | 1.40 | 1.41 | 1.41 | 1.42 | 1.41 | 1.41 | 1.41 | 1.41 |

EXAMPLE III

For successful operation of a simplified bleaching equence such as the $C_DE(DED)$ sequence, where the etention time in each of the $D_1$ and $E_2$ stages is 10 inutes or less, it is desirable to minimize the residual hlorine dioxide carried forward with the pulp into the econd extraction stage. Under the highly alkaline conitions of the second extraction stage, the residual chloine dioxide causes degradation and lowers the viscosity f the pulp as shown by the results in the graph of the rawing of FIG. 1, where a chlorinated and extracted orthwestern Canadian softwood pulp was bleached nder conditions where the $ClO_2$ applied in the $D_1$ stage vas varied from 0.6 to 1.0 percent on pulp, the initial H was varied from 4 to 8, and the retention time was aried from 4.5 to 9.5 minutes. A similar optimization xperiment was run in which the $ClO_2$ applied was aried from 0.4 to 0.8 percent on pulp, the initial pH vas varied from 2 to 6 and the time from 4.5 to 9.5 ninutes. The final pH in the $E_2$ stage was close to 10.5 nd the total $ClO_2$ applied in the $D_1$ plus $D_2$ was 1.4 ercent on pulp. Results of these optimization experinents show that compared with a conventional $C_DEDED$ bleach sequence where 1.0 percent $ClO_2$ is pplied in the $D_1$ stage for normal retention times of up o 3 hours, the simplified $C_DE(DED)$ sequence of the resent invention gives the same brightness with higher iscosity when 0.6 percent $ClO_2$ on pulp is applied in $D_1$ at an initial pH of 4 and a retention time of 4.5 minites. However, the process of the invention may be perated in the range 0.4 to 0.8 percent $ClO_2$ on pulp in $D_1$ at an initial pH ranging from 2 to 8 and with retenion times ranging from 4 to 10 minutes. This reduction n bleaching time makes it possible to carry out the $D_1$ stage in small diameter tubes such that the pulp can be emoved from the $D_1$ stage without the need for diluion to low consistency and the need for a washer to hicken the pulp to the consistency of the second extracion stage. Similarly, since the $E_2$ stage is run at 5 to 10 minutes retention, the pulp can be passed directly to the $D_2$ stage on the mill scale without the need for a washer.

This following example defines the preferred condiions for the simplified $C_DE(HDED)$ bleach sequence.

EXAMPLE IV

In conventional $C_DEHDED$ bleacheries, the (H) stage is normally carried out in a conventional 60 to 90 minute retention bleach tower at 30° C. to 50° C. This ow temperature stage in the midst of higher temperaure (E) and (D) stages had made it necessary to use old water to cool the pulp for the hypochlorite stage in onventional bleacheries, thus increasing both water and steam consumption to heat the pulp up again for later bleach stages. In conventional downflow bleach towers, it is necessary to dilute the pulp in order to remove it from the tower, and it then has to be thickened at a washer for the next bleach stage. By reducing the retention time in the (H), $D_1$ and $E_2$ stages of a simplified $C_DE(HDED)$ bleachery, in accordance with the present invention, to less than 10 minutes, it is possible to carry out these stages in tubes such that the pulp does not need to be diluted and washed between stages. The short retention in the (H) stage is accomplished by using a higher temperature in the range of 70° C. to 90° C.

Chlorinated and extracted northwestern Canadian softwood pulp was bleached by the simplified $C_DE(HDED)$ bleach sequence in a three-level five-factor Box Behnken experimental design where the $ClO_2$ applied in $D_1$ was varied from 0.4 to 0.8 percent on pulp, the $D_1$ initial pH was varied from 4.0 to 8.0, the $D_1$ time was varied from 4.5 to 9.5 minutes, the $E_2$ final pH was varied from 9.5 to 11.5, and the $E_2$ retention time was varied from 4.5 to 9.5 minutes. The results showed that preferably 0.4 percent $ClO_2$ on pulp or 33 percent of the total $ClO_2$ should be applied in $D_1$ compared with from 30 to 70 percent of the total $ClO_2$ being applied in the $D_1$ stage of a conventional bleachery. Preferably, the stage is carried out with an initial pH in the range of 4 to 6 and with a retention time of 5 to 10 minutes. The preferred retention time in $E_2$ is 5 minutes; increasing the time has no effect on brightness but does lower viscosity. The preferred final pH in $E_2$ is 9.5, however, higher pH up to 11.5 can result in a gain in brightness of 0.5 points at the expense of lower viscosity in the order of 1.0 cp T-230 (Tappi Test T-230).

EXAMPLE V

A southern United States pine kraft pulp was chlorinated and washed followed by a 20 minute retention first extraction stage. The washed extracted pulp was subdivided and bleached by the $C_DE(DED)$ and $C_DE(HDED)$ according to the conditions shown in Table V, below. In these cases, all of the stages within the brackets including the final chlorine dioxide stage were of short duration and there was no interstage washing between the stages shown within the brackets.

This example shows that the first extraction stage and the final chlorine dioxide stage are not limited to the long retention normally associated with conventional bleacheries. Similarly, if higher temperature is used in the chlorination stage, that stage can also be of short retention time.

EXAMPLE V

TABLE V

| EXAMPLE V | | |
|---|---|---|
| Unbleached Pulp: | Roe No. 5.22, Kappa No. 31.1, Visc. (T-230) 35.0 cp. | |
| Chlorination: | 6.27% $Cl_2$ + 0.2% $ClO_2$ on pulp, 3.0% consistency, 30° C., 1 hour | |
| Extraction: | 2.7% NaOH on pulp, 11% consistency, 80° C., 20 minutes, Kappa No. 4.12, Visc. (T-230) 29.6 cp. | |
| | $C_DE(HDED)$ Sequence | $C_DE(DED)$ Sequence |
| Hypochlorite Stage | | |
| Hypochlorite applied, % $Cl_2$ on pulp | 0.50 | |
| NaOH applied, % on pulp | 0.35 | |
| consistency, % | 11.0 | |
| Temperature, °C. | 9.0 | |
| Time, min. | 6 | |
| Elrepho Brightness | 59.2 | |
| First $ClO_2$ Stage | | |
| $ClO_2$ applied, % on pulp | 0.45 | 0.71 |
| Consistency, % | 10.0 | 11.0 |
| Temperature, °C. | 80 | 80 |
| Time, min. | 10 | 10 |
| Initial/Final pH | 5.8/3.1 | 6.1/2.7 |
| Residual $ClO_2$, % | nil | nil |
| Brightness | 83.5 | 79.5 |
| Second Extraction Stage | | |
| NaOH applied, % on pulp | 0.60 | 0.70 |
| Consistency, % | 10.1 | 10.9 |

TABLE V-continued

| EXAMPLE V | |
|---|---|
| Unbleached Pulp: | Roe No. 5.22, Kappa No. 31.1, Visc. (T-230) 35.0 cp. |
| Chlorination: | 6.27% $Cl_2$ + 0.2% $ClO_2$ on pulp, 3.0% consistency, 30° C., 1 hour |
| Extraction: | 2.7% NaOH on pulp, 11% consistency, 80° C., 20 minutes, Kappa No. 4.12, Visc. (T-230) 29.6 cp. |

| | $C_DE$(HDED) Sequence | | | $C_DE$(DED) Sequence | | |
|---|---|---|---|---|---|---|
| Temperature, °C. | | 80 | | | 80 | |
| Time, min. | | 10 | | | 10 | |
| Final pH | | 10.7 | | | 10.5 | |
| Second Chlorine Dioxide Stage | | | | | | |
| $ClO_2$ applied, % on pulp | | 0.54 | | | 0.47 | |
| consistency, % | | 8.7 | | | 9.7 | |
| Temperature, °C. | | 80 | | | 80 | |
| Time, min. | 10 | 20 | 30 | 10 | 20 | 30 |
| Initial pH | 5.9 | 5.9 | 5.9 | 6.0 | 6.0 | 6.0 |
| Final pH | 3.7 | 3.4 | 3.0 | 3.9 | 3.7 | 2.7 |
| Residual $ClO_2$, % on pulp | 0.03 | 0.02 | nil | 0.03 | 0.01 | nil |
| Brightness, Elrepho | 90.3 | 91.0 | 90.8 | 90.0 | 90.5 | 90.5 |
| Visc. cp. (centipoise) | 25.2 | | | 24.2 | | |

EXAMPLE VI

This example depicts the operation of an embodiment of the invention in a closed cycle operation.

A southern hardwood kraft pulp was bleached by the (DC)E(HD) sequence where (DC) represents sequential addition of chlorine dioxide and chlorine, and (HD) represents sequential addition of hypochlorite and chlorine dioxide without interstage washing. The hypochlorite stage was carried out at 80° C. for 6 minutes retention. There were only 3 washing stages, namely, after (DC), after E, and after (HD). The flowsheet of FIG. 2 also shows a decker normally located ahead of the high density storage chest for unbleached pulp. The chemical and wash water flows are shown in U.S. gal/air dry ton of bleached pulp (ADBT).

Fresh water was used only for shower water on the (HD) washer and for level control in the (HD) seal tank so that there was sufficient (HD) filtrate to provide the countercurrent flow shown for shower water on the E and (DC) washers. E stage filtrate was used for the top showers on the (DC) washer as shown. (DC) filtrate was used for shower water on the decker and for dilution of the high density brown stock storage chest ahead of chlorination.

Excess filtrates from the decker (DC) and E washers totalled 3891 U.S. gal/ADBT. These could have been even more concentrated if 12 g./l. $ClO_2$ had been available for chlorination instead of the 6 g./l. used in the laboratory study. The total of the filtrates from these sources was low enough for internal use in the Rapson-Reeve closed cycle bleached kraft mill process.

Table VI, below, depicts the details of bleaching conditions for a control bleach using fresh water on all three washers and for the 18th cycle of countercurrent washing representing a steady state condition with respect to impurities in the filtrates. The chemical consumption at cycle 18 is almost the same as the control. Brightness and viscosity are also the same for these bleaches.

TABLE VI

| | |
|---|---|
| Southern Hardwood Kraft Pulp: | Kappa No. 15.5, Roe No. 1.55, Visc. 24 cp. |
| Chlorination: | Sequential addition of 0.66% $ClO_2$ and 0.74% $Cl_2$, 3.5% consistency, 30° C., 60 minutes |
| Extraction: | 11% consistency, 80° C., 60 minutes |
| Hypochlorite: | 11% consistency, 80° C., 6 minutes, no wash |
| Chlorine dioxide: | 10% consistency, 80° C. |

| | Fresh Water | Cycle 18* |
|---|---|---|
| Chlorination | | |
| Final pH | 2.3 | 1.9 |
| Extraction | | |
| NaOH applied, % on pulp | 1.8 | 1.9 |
| Final pH | 10.6 | 11.5 |
| Viscosity T-230 cp | 23.6 | 24.1 |
| Hypochlorite | | |
| NaOCl applied, as % $Cl_2$ on pulp | 0.40 | 0.43 |
| NaOH applied, % on pulp | 0.30 | 0.20 |
| Brightness, Elrepho | 71.9 | 71.3 |
| Viscosity, T-230 cp | 21.7 | 21.6 |
| Chlorine dioxide | | |
| $ClO_2$ applied, % on pulp | 0.65 | 0.65 |
| $H_2SO_4$ applied, % on pulp | 0.26 | 0.32 |
| Initial pH | 6.2 | 5.9 |
| Final pH | 3.3 | 3.7 |
| $ClO_2$ consumed, % on pulp | 0.60 | 0.61 |
| Brightness, Elrepho | 87.8 | 87.8 |
| Viscosity, T-230 cp | 20.0 | 21.1 |

Figure 2:
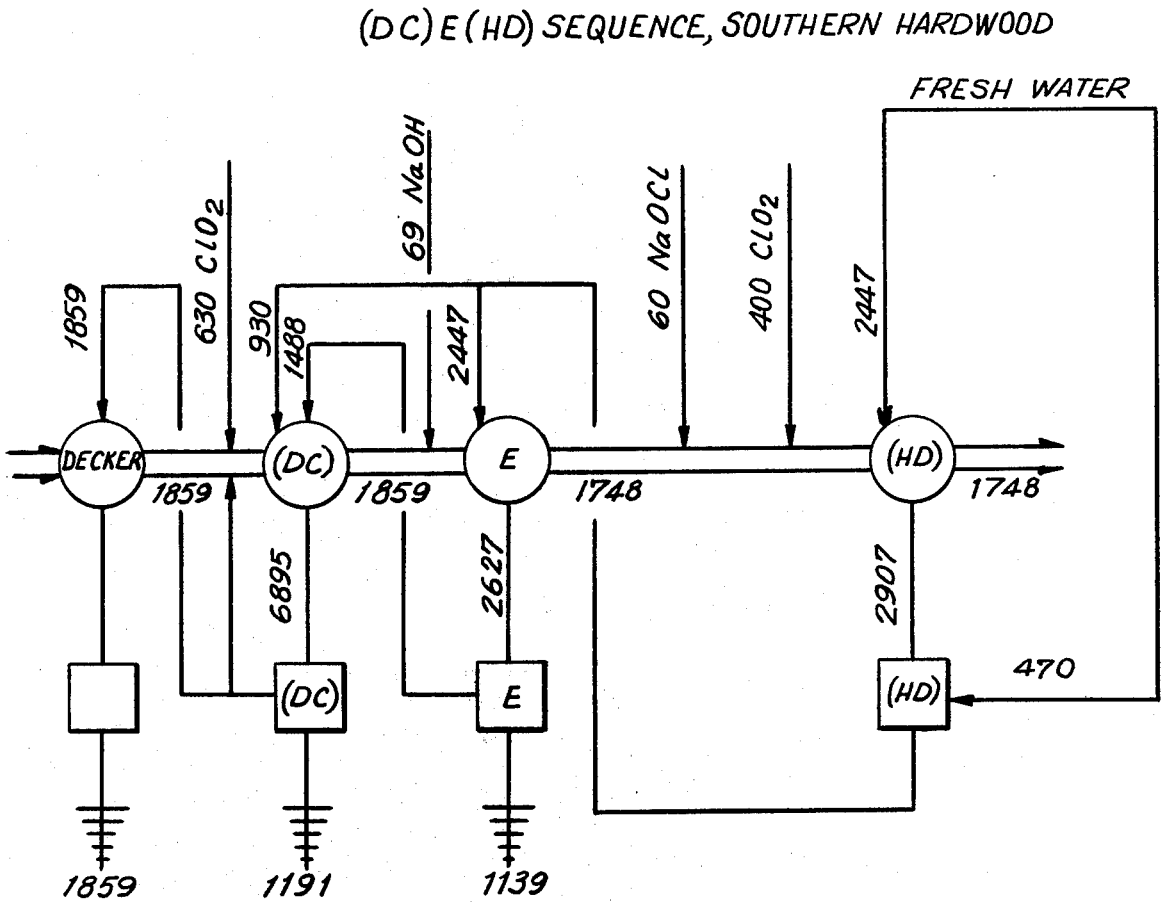
FIG. 2 is a simplified schematic flow diagram of a bleaching process in accordance with one embodiment of the invention, described in Example VI, below.

*See flowsheet FIG. 2

EXAMPLE VII

This example compares, under closed cycle operation, a sequence in accordance with the present invention with one using customary washings.

Samples from the same lot of an Eastern Canadian softwood kraft pulp were bleached by both the simplified bleaching sequence (DC)E(HD) of the invention and the standard $D_CEDED$ bleach sequences using tight systems of countercurrent washing as required for closed cycle operation. Schematic flowsheets for both countercurrent washing systems are shown on FIGS. 3 and 4, respectively. The double horizontal line indicates pulp flow through the bleachery and the numbers represent the water contained by the pulp as the pulp leaves each washer expressed as U.S. gal/ADBT (air dry bleached ton of pulp). Water added with chemicals is indicated by arrows pointed at the pulp flow and shower water is indicated by arrows pointed at the washer drums. The flows between the washer drums and seal tanks are net flows neglecting recycled filtrate for tower and washer vat dilution. Both flowsheets also neglect to show approximately 180 U.S. gal/ADBT of water used for wire cleaning showers. Therefore, the effluent from both $E_1$ stages should be increased by 180 U.S. gal/ADBT. Note that the flow system for the (DC)E(HD) sequence is much simpler than for the $D_CEDED$ sequence. The (HD) seal tank is on level control providing the required amount of fresh water to keep the showers on the (DC) and E washers in balance. Besides having the flows to and from two fewer washers to keep in balance, the (DC)E(HD) sequence has two fewer washers from which spills, on the commercial scale, can occur and it does not have cascaded seal tanks as shown in FIG. 4 for the $D_CEDED$ sequence. Upsets in the cascaded flows from these seal tanks can present problems with pH control in the various bleach stages connected to them.

Tables VII and VIII, below, show the bleaching conditions used for the 15th countercurrent washing cycle of the (DC)E(HD) sequence and the 27th cycle of the $D_C$EDED sequence, respectively. Both systems represent steady state operation. Table IX shows that both pulps have the same brightness, but the (DC)E(HD) pulp has lower viscosity and beating time due to viscosity loss in the hypochlorite stage. Although tear for the (DC)E(HD) pulp is lower, there are no significant differences in mullen and breaking length between the two sequences. This confirms, for closed cycle operation, the results shown in Example 1 for similar bleach sequences.

Figure 3:
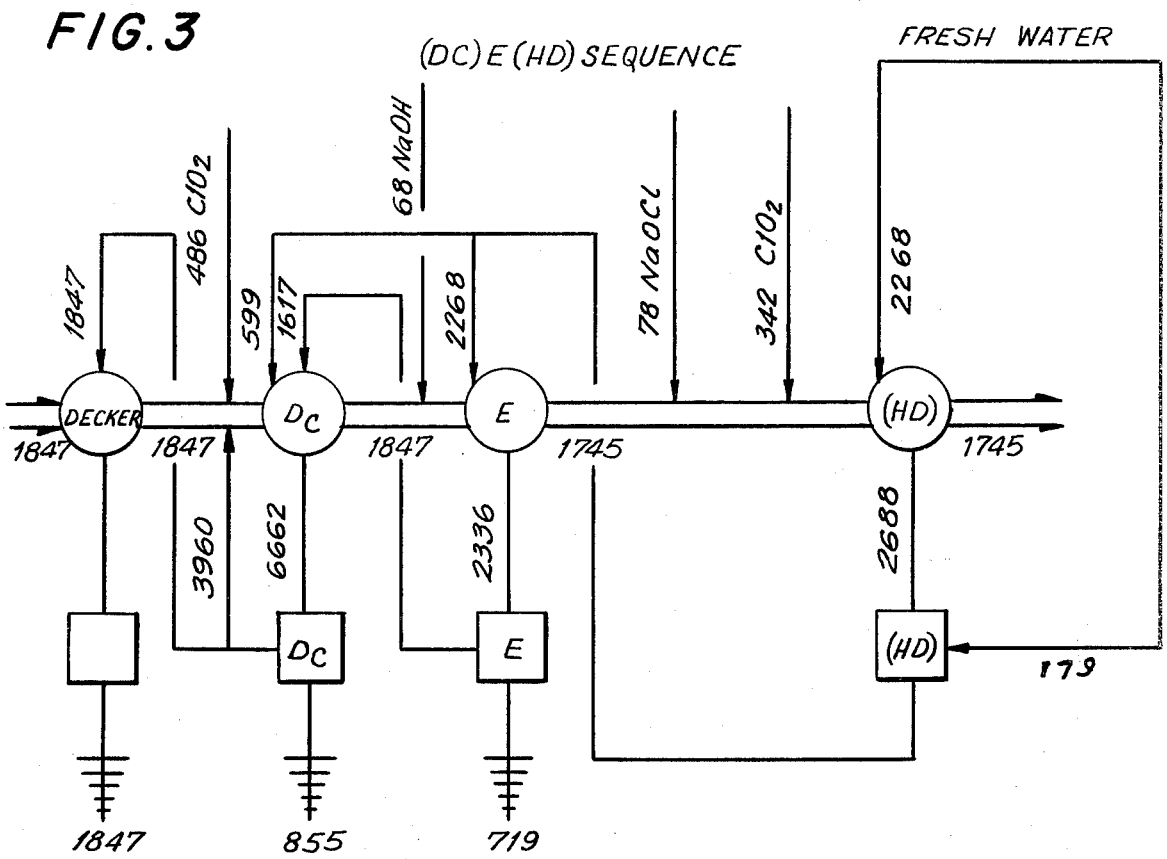
FIGS. 3 and 4 are simplified schematic flow diagrams of, respectively, two sequences compared in Example VII, below.
Figure 4:
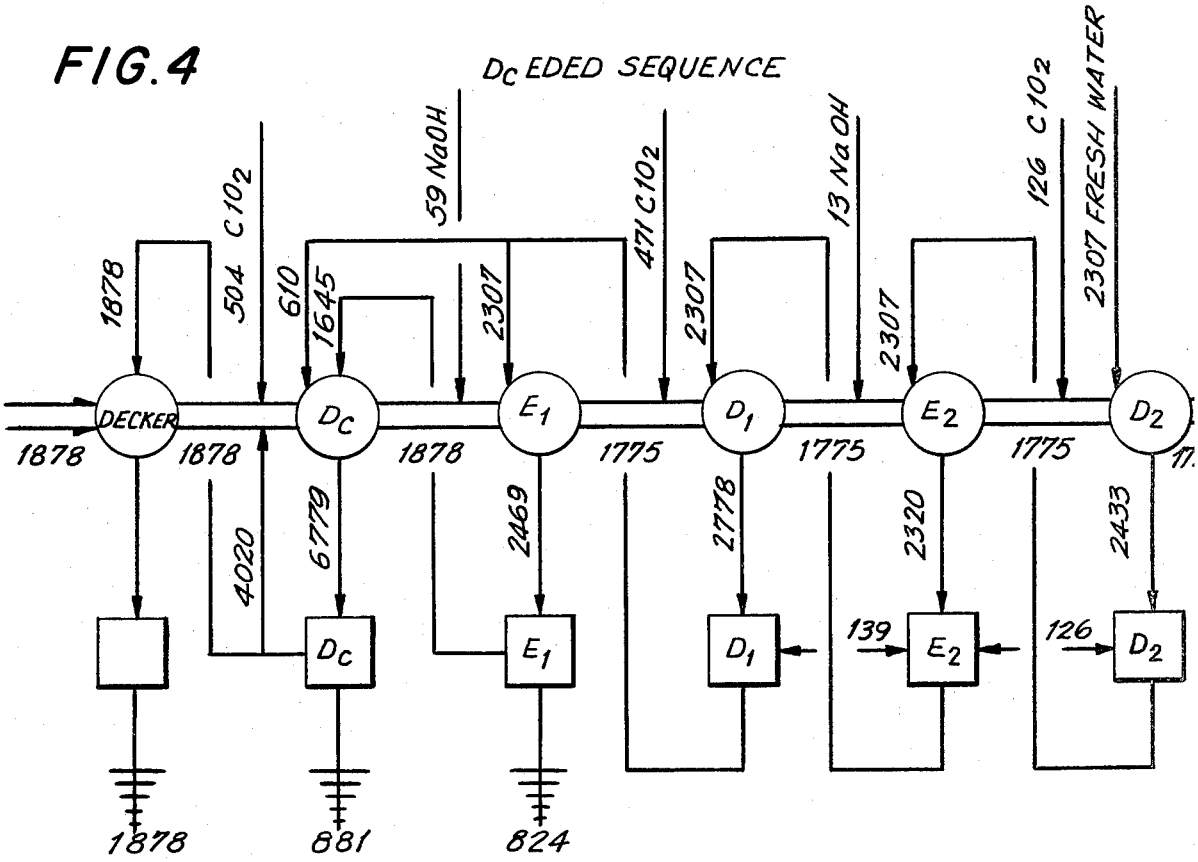
Figure 5:
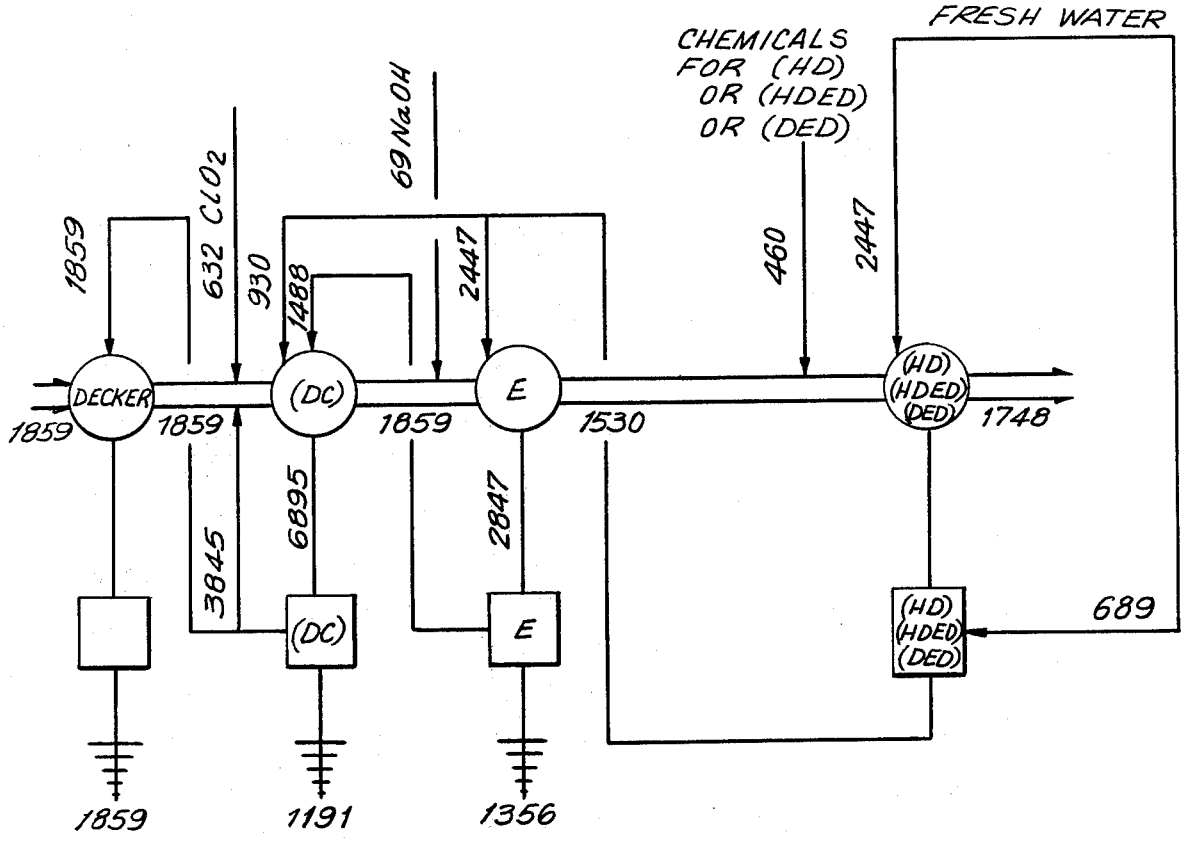
FIG. 5 is a simplified flow diagram of a bleaching operation in accordance with embodiments prescribed in EXAMPLE VIII, below.

The general flow sheet for the other simplified bleach sequences such as (DC)E(HDED) or (DC)E(DED) would be the same as FIG. 3 except that different bleach chemicals would be added to the pulp flow between the E stage washer and the final washer.

TABLE VIII

| Cycle 27 of $D_C$EDED Bleach Sequence | |
|---|---|
| Northeastern Canadian Softwood Pulp: | No. 23.8, Visc. T-230 25.5 cp. |
| Chlorination: | 1.52% $ClO_2$ + 1.71 Cl applied as mixture, 3.5% consistency, 25° C., 60 minutes |
| Extraction: | 2.5% NaOH on pulp, 10.7% consistency, 80° C., 60 minutes |
| Chlorine dioxide: | 1.53% on pulp, 8.9% consistency, 80° C., 60 minutes |
| Extraction: | 0.61% NaOH on pulp, 10.8% consistency, 80° C., 60 minutes |
| Chlorine dioxide: | 0.41% $ClO_2$ on pulp, 10.2% consistency, 80° C., 180 minutes |

| | Cycle 27 |
|---|---|
| Chlorination | |
| Final pH | 1.9 |
| Extraction | |
| Final pH | 11.0 |
| Chlorine dioxide | |
| $ClO_2$ residual, % on pulp | 0.02 |
| $H_2SO_4$, % on pulp | 0.23 |
| Initial pH | 4.4 |
| Final pH | 2.4 |
| Brightness, Elrepho | 83.2 |
| Extraction | |
| Final pH | 10.6 |
| Chlorine dioxide | |
| $ClO_2$ residual, % on pulp | 0.02 |
| $H_2SO_4$, % on pulp | 0.21 |
| Initial pH | 4.2 |
| Final pH | 2.8 |
| Brightness | 92.0 |
| Viscosity, T-230 cp. | 21.8 |

TABLE VII

| Cycle 15 of the (DC)E(HD) Bleach Sequence | |
|---|---|
| Northeastern Canadian Softwood Pulp: | Kappa No. 23.8, Visc. T-230 25.5 cp. |
| Chlorination: | 1.52% $ClO_2$ followed by 1.71% $Cl_2$ applied sequentially after 5 minutes, 3.5% consistency, 25° C., 60 minutes |
| Extraction: | 3.0% NaOH on pulp, 10.7% consistency, 80° C., 60 minutes |
| Hypochlorite: | 1.15% $Cl_2$, 0.39% NaOH, 10.7% consistency, 90° C., 6 minutes, NO WASH |
| Chlorine dioxide: | 1.10% $ClO_2$ on pulp, 9.1% consistency, 80° C., 180 minutes |

| | Cycle 15 |
|---|---|
| Chlorination | |
| Final pH | 1.6 |
| Extraction | |
| Final pH | 11.2 |
| Hypochlorite | |
| Final pH | 9.6 |
| Brightness | 75.0 |
| Viscosity, cp. | 14.3 |
| Chlorine dioxide | |
| $ClO_2$ residual, % on pulp | 0.07 |
| Initial pH | 6.3 |
| Final pH | 3.8 |
| Brightness | 92.1 |
| Viscosity, cp. | 14.5 |

TABLE IX

Comparison of Pulp Quality from the Simplified (DC)E(HD) and the Conventional $D_C$EDED Bleach Sequences Operated Under Closed Cycle Conditions

| | (DC)E(HD) Cycle 15 | $D_C$EDED Cycle 27 |
|---|---|---|
| Brightness | 92.1 | 92.0 |
| Viscosity, cp. | 14.5 | 21.8 |
| Physical Properties at 500 CSF | | |
| Beating Time, min. | 2.80 | 3.32 |
| Tear Factor | 104 | 109 |
| Mullen, % pts/lb | 178 | 180 |
| Breaking Length, M | 11,000 | 10,500 |
| Physical Properties at 300 CSF | | |
| Beating Time, min. | 5.21 | 6.22 |
| Tear Factor | 92 | 98 |
| Mullen, % pts/lb | 192 | 194 |
| Breaking Length, M | 12,100 | 12,400 |

EXAMPLE VIII

This example compares bleaching by several sequences in accordance with the invention.

A southern pine kraft pulp was bleached using the (DC)E(HD), (DC)E(HDED) and (DC)E(DED) bleach sequences. The bleaching conditions are shown in Table X and the countercurrent washing system shown in FIG. 5. The same total amount of water was added with the chemical for the (HD), (HDED) and (DED) stages so that the countercurrent flows remained the same despite changes in sequence.

Table X, below, shows that the control, where fresh water was used on each washer, required approximately 1.35 percent less total available chlorine for bleaching. The extra bleach was primarily consumed by carryover of dissolved colored matter leaving the $E_1$ washer. Good quality pulp can be made by each of these bleach sequences using the same countercurrent washing system.

TABLE X

Southern Pine Kraft Pulp: Roe No. 5.35, Kappa No. 36.4, Visc. 31.1 cp.
Chlorination: 1.85% $ClO_2$ added 5 min. before 2.09% $Cl_2$ on pulp, 3.5% consistency, 30° C., 1 hour
Extraction: 2.6% NaOH on pulp, 11% consistency, 80° C., 60 min.
Hypochlorite in (DC)E(HD) and (DC)E(HDED) sequences: 11% consistency, 80° C., 6 min.
$D_1$ in (DC)E(HDED) and (DC)E(DED) sequences: about 10% consistency, 80° C., 5 min.
$E_2$ in (DC)E(HDED) and (DC)E(DED) sequences: about 10% consistency, 80° C., 5 min.
Final D stage all sequences: about 9% consistency, 80° C., 3 hours

| Bleach Sequence | (DC)E(HD) | | (DC)E(HDED) | (DC)E(DED) |
|---|---|---|---|---|
| Cycle No. | Control | 39 | 45 | 49 |
| Chlorination, (DC) | | | | |
| Final pH | 1.8 | 1.6 | 1.6 | 1.6 |
| Extraction, $E_1$ | | | | |
| Final pH | 10.4 | 10.9 | 10.7 | 10.6 |
| Viscosity, cp. | 34.2 | 33.5 | 32.9 | 35.3 |
| Hypochlorite, H | | | | |
| NaOCl, % $Cl_2$ on pulp | 0.95 | 1.30 | 1.20 | N.A. |
| NaOH, % on pulp | 0.30 | 0.16 | 0.13 | |
| Final pH | 10.1 | 9.1 | 9.2 | |
| Viscosity, cp. | 22.5 | 18.9 | 18.3 | |
| Brightness | 75.7 | 75.3 | 75.3 | |
| Chlorine Dioxide, $D_1$ | | | | |
| $ClO_2$ applied, % on pulp | N.A. | N.A. | 0.63 | 0.80 |
| $H_2SO_4$, % on pulp | | | 0.10 | — |
| NaOH, % on pulp | | | — | 0.27 |
| Initial/Final pH | | | 5.9/4.1 | 5.8/3.0 |
| Viscosity, cp. | | | — | 29.8 |
| Brightness | | | 86.0 | 76.6 |
| Extraction, $E_2$ | | | | |
| NaOH applied, % on pulp | N.A. | N.A. | 0.45 | 0.80 |
| Final pH | | | 9.9 | 10.2 |
| Final Chlorine Dioxide | | | | |
| $ClO_2$ applied, % on pulp | 0.69 | 1.10 | 0.48 | 0.77 |
| $H_2SO_4$, % on pulp | 0.06 | 0.06 | 0.06 | 0.20 |
| Initial/Final pH | 5.7/2.6 | 5.6/3.0 | 5.8/4.6 | 5.6/3.6 |
| Viscosity, cp. | 21.1 | 18.3 | 17.9 | 33.0 |
| Brightness | 90.1 | 90.9 | 91.2 | 88.9 |
| Total Oxidizing Chemical as $Cl_2$ | 9.72 | 11.04 | 11.06 | 11.10 |
| Physical Properties at 300 CSF | | | | |
| Tear Factor | 131 | 124 | 122 | 128 |
| Mullen, % pts/lb | 143 | 147 | 147 | 153 |
| Breaking Length, meters | 9000 | 10500 | 9500 | 10100 |

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A multi-stage, sequential bleaching process for lkaline cooked pulps, in which the bleaching stages are onducted with conventional static flow of the pulp uring retention periods so that there is no substantial ıovement of the bleaching liquid employed with respect to the fibers making up said pulp, and in which here is a sequence of at least four bleaching stages and o more than three washing steps, and in which the ıitial bleaching stage of said sequence comprises a hlorination with a member selected from the class onsisting of chlorine, chlorine dioxide, mixtures and equential use thereof, and the final bleaching stage of vhich sequence comprises a chlorine dioxide bleaching tage, which process comprises subjecting said alkaline ooked pulp to said sequence of at least four bleaching tages and washing said pulp only subsequent to said irst and final stages and subsequent to an initial alkali xtraction stage, and where all bleaching stages subseuent to said initial alkali extraction stage up to said inal chlorine dioxide stage are shortened to less than bout 15 minutes.

2. A multi-stage, sequential, bleaching process acording to claim 1, wherein all bleaching stages subseuent to said initial alkali extraction stage and prior to aid final bleaching stage are shortened to less than bout 15 minutes.

3. A multi-stage, sequential, bleaching process acording to claim 1, wherein all bleaching stages subseuent to said initial chlorination stage and prior to said nal bleaching stage are shortened to less than about 15 ıinutes.

4. A multi-stage, sequential, bleaching process acording to claim 1, wherein all bleaching stages subseuent to said initial alkali extraction stage and prior to aid final bleaching stage are shortened to between bout 5 to 10 minutes.

5. A multi-stage, sequential, bleaching process acording to claim 1, wherein all bleaching stages subseuent to said initial alkali extraction stage and prior to aid final bleaching stage are shortened to less than bout 5 minutes.

6. A multi-stage, sequential, bleaching process acording to claim 1, wherein the sequence includes at east one hypochlorite bleaching stage in which said ypochlorite bleaching stage is conducted at a temperaıre in the range of between about 70° and 90° C.

7. A multi-stage, sequential, bleaching process acording to claim 1, comprising a sequence of an initial hlorine and/or chlorine dioxide bleaching stage folowed by stages of alkali extraction, hypochlorite and hlorine dioxide bleaching, wherein washings are emloyed subsequent to the initial stage, the alkali extracon stage, and the final chlorine dioxide stage, and said ypochlorite bleaching stage is conducted at a temperaıre of between about 70° and 90° C. and for a period of ss than about 15 minutes.

8. A multi-stage, sequential, bleaching process acording to claim 1, comprising an initial chlorine and/or hlorine dioxide bleaching stage followed by a seuence of initial alkali extraction, initial chlorine dioxle, second alkali extraction and final chlorine dioxide ages, wherein washings are employed only subsequent the initial stage, the initial alkali extraction stage, and ıbsequent to the final chlorine dioxide stage, and the ıitial chlorine dioxide and second alkali extraction ages are of shortened duration of less than about 15 ıinutes.

9. A multi-stage, sequential, bleaching process according to claim 1, comprising an initial chlorine and/or chlorine dioxide bleaching stage followed by a sequence of alkali extraction, chlorine dioxide, alkali extraction and chlorine dioxide, wherein washings are employed only subsequent to the initial stage, the first alkali extraction stage, and subsequent to the final chlorine dioxide stage, and the first chlorine dioxide stage and second alkali extraction stage are of shortened duration of between about 5 and 10 minutes.

10. A multi-stage, sequential, bleaching process according to claim 1, comprising a sequence of an initial chlorine and/or chlorine dioxide bleaching stage followed by a sequence of initial alkali extraction, hypochlorite, initial chlorine dioxide, second alkali extraction and final chlorine dioxide stages, wherein washings are employed only subsequent to the initial stage, the initial alkali extraction stage, and subsequent to the final chlorine dioxide stage, and the hypochlorite, initial chlorine dioxide and second alkali extraction stages are each of shortened duration of less than about 15 minutes.

11. A multi-stage, sequential, bleaching process according to claim 1, comprising an initial chlorine and chlorine dioxide bleaching stage followed by a sequence of initial alkali extraction, hypochlorite, initial chlorine dioxide, second alkali extraction and final chlorine dioxide stages, wherein washings are employed only subsequent to the initial stage, the initial alkali extraction stage, and subsequent to the final chlorine dioxide stage and the hypochlorite, initial chlorine dioxide and second alkali extraction stages are each of shortened duration of between about 5 and 10 minutes.

12. A process according to claim 1, wherein a high viscosity pulp at high brightness is made using the $C_DE(HD)$ sequence.

13. A process according to claim 1, wherein pulp from a hypochlorite and/or chlorine dioxide stage followed by an alkaline extraction stage, or a hypochlorite stage alone, is carried into the final chlorine dioxide stage without washing.

14. A multi-stage, sequential, bleaching process according to claim 1, in which the sequence employed is an initial chlorine dioxide and chlorine bleaching stage, without intermediate washing, followed by washing, then a sequence of alkali extraction, washing, and then stages by hypochlorite and chlorine dioxide bleaching without intermediate washing.

15. A multi-stage, sequential, bleaching process according to claim 1, in which the sequence employed is an initial chlorine dioxide and chlorine bleaching stage, without intermediate washing, followed by a washing stage, then a sequence of alkali extraction, washing, followed by stages of chlorine dioxide, alkaline extraction and chlorine dioxide bleaching without intermediate washings.

16. A multi-stage, sequential, bleaching process according to claim 1, in which the sequence employed is an initial chlorine dioxide and chlorine bleaching stage, without intermediate washing, followed by a washing stage, then a sequence of alkali extraction, washing, followed by stages of hypochlorite, chlorine dioxide, alkali extraction and chlorine dioxide without intermediate washings.

17. A multi-stage, sequential, bleaching process according to claim 1, employing more than one chlorine dioxide bleaching stage, wherein the initial chlorine dioxide treatment stage is shortened to less than about 15 minutes.

18. A multi-stage, sequential, bleaching process according to claim 1, comprising an initial chlorine and chlorine dioxide bleaching stage followed by washing, an initial alkali extraction stage followed by washing and a short retention hypochlorite stage with no wash prior to a final chlorine dioxide stage, followed, in turn, by washing in which the wash water from the said three washers is used in a countercurrent fashion to achieve a low volume of effluent, a low consumption of water and energy, wherein fresh water is used on the third washer to wash the fully bleached pulp, filtrate from the third washer is used countercurrent on the second stage washer, filtrate from the second stage washer is used in the first stage washing, while avoiding passage of the filtrate through the pulp, first stage filtrate is used for shower water as well as for dilution of pulp leaving high density storage prior to first stage chlorination, and the highly concentrated excess first and second stage filtrates are used in either internal or external treatment systems.

19. A multi-stage, sequential bleaching process according to claim 18, in which the sequence employed is an initial chlorine dioxide and chlorine bleaching stage, without intermediate washing, followed by washing, then a sequence of alkali extraction, washing, and then stages of hypochlorite and chlorine dioxide bleaching without intermediate washing.

20. A multi-stage, sequential, bleaching process according to claim 18, in which the sequence employed is an initial chlorine dioxide and chlorine bleaching stage, without intermediate washing, followed by a washing stage, then a sequence of alkali extraction, washing, followed by stages of chlorine dioxide, alkali extraction and chlorine dioxide bleaching without intermediate washings.

21. A multi-stage, sequential, bleaching process according to claim 18, in which the sequence employed is an initial chlorine dioxide and chlorine bleaching stage, without intemrediate washing, followed by a washing stage, then a sequence of alkali extraction, washing, followed by stages of hypochlorite, chlorine dioxide, alkali extraction and chlorine dioxide without intermediate washings.

* * * * *

UNITED STATES PATENT AND TRADEMARK OFFICE

CERTIFICATE OF CORRECTION

PATENT NO. : 4,238,281

DATED : December 9, 1980

INVENTOR(S) : John A. Histed

It is certified that error appears in the above—identified patent and that said Letters Patent is hereby corrected as shown below:

Column 3, line 45, "was" should read --wash--; line 66, "slower" should read --shower--;

Column 10, end of eighth row of numerical data, "0.86" should read --0.39--;

Column 13, Table IV, beginning of line between fifth and sixth rows of data, "550 CSF" should read --500 CSF--;

Column 14, Table IV, twelfth line of numerical data, third and fourth numbers from end, "147.5" should read --1.475--;

Column 16, Table V, fourth line of numerical data, "9.0" should read --90--;

Column 20, line 3, --Kappa-- should precede "No. 23.8"; and

Column 26, line 19, "intemrediate" should read --intermediate--.

Signed and Sealed this

*Fifteenth* Day of *September 1981*

[SEAL]

*Attest:*

GERALD J. MOSSINGHOFF

*Attesting Officer*

*Commissioner of Patents and Trademarks*